US006076946A

United States Patent [19]

Brouillette, III et al.

[11] Patent Number: 6,076,946

[45] Date of Patent: Jun. 20, 2000

[54] FLASHLIGHT HOUSING WITH MULTIPLE SURFACE ANGLES FOR DIRECTING LIGHT

[76] Inventors: Thomas Brouillette, III; Thomas Brouillette, Jr., both of 3536 Linda Vista Dr., San Marcos, Calif. 92069

[21] Appl. No.: 09/246,083

[22] Filed: Feb. 5, 1999

[51] Int. Cl.[7] ..... F21L 7/00

[52] U.S. Cl. ..... 362/362; 362/190; 362/191; 362/183; 362/186; 362/363; 362/397; 362/398; 446/431; 446/438; 446/484; 446/485; 446/901

[58] Field of Search ..... 362/183, 186, 362/190, 191, 196, 362, 363, 367, 368, 389, 387, 398, 806, 809; 446/8, 85, 219, 227, 439, 438, 485, 484, 199, 901; 273/348.2, 348.3, 348.4, 348.5, 118 R, 447, 448

[56] References Cited

U.S. PATENT DOCUMENTS

| | | | |
|---|---|---|---|
| 3,458,205 | 7/1969 | Smith et al. | 273/213 |
| 4,321,660 | 3/1982 | Sokol . | |
| 4,388,674 | 6/1983 | Sano . | |
| 4,425,602 | 1/1984 | Lansing | 362/186 |
| 4,428,033 | 1/1984 | McBride . | |
| 4,533,982 | 8/1985 | Kozar . | |
| 4,564,894 | 1/1986 | Gonzalez . | |
| 4,881,155 | 11/1989 | Gahagan . | |
| 5,054,778 | 10/1991 | Maleyko | 273/58 |
| 5,228,686 | 7/1993 | Maleyko | 273/58 |
| 5,537,111 | 7/1996 | Martin et al. | 340/983 |

*Primary Examiner*—Sandra O'Shea
*Assistant Examiner*—Ismael Negron

[57] ABSTRACT

A spherical housing (11) having multiple flats (1–8) about the surface of the housing with adhesive means (i.e. . . . magnets) that enable it to adhere to an alternate surface. Multiple flats (1–8) are arranged around the housing (11) for the purpose of directing light in many directions.

1 Claim, 2 Drawing Sheets

( FRONT VIEW )

( REAR VIEW )

( SIDE VIEW )

FLASHLIGHT HOUSING WITH MULTIPLE SURFACE ANGLES FOR DIRECTING LIGHT

BACKGROUND

1. Field of Invention

This invention relates to flashlights (or flashlight housings) that rest on, or adhere to, a surface from which they can direct focused light in any direction.

2. Description of Prior Art

Mechanics, trades persons, and other consumers of portable lighting are challenged by the present structure and lighting capability of flashlights. Working with two hands in dark and sometimes small spaces demands specific structural requirements: the light must be compact, easy to use, be able to adhere itself at any angle, and direct light in any direction.

Inventors have proposed many solutions attempting to satisfy these requirements. U.S. Pat. No. 4,428,033 to McBride (1982) directs light with the use of a pivotally moving socket attached to a single magnet, flexible lead system, hook, and suction cup (all in one patent!). Like so many other patented flashlights light is directed with extraneous means (ball and socket, rotating hinge, flexible snake type, etc . . . ) boosting the cost of manufacturing and difficulty for the user. Also, repeated use of these movable joints can cause damage to electrical components.

Other attempts include U.S. Pat. No. 4,564,894 to Gonzalez (1986) which employs a bracket (with angular magnets) mounted to a flashlight, but this bracket is additive to the light source and has very limited angles for directing light. U.S. Pat. No. 4,881,155 to Gahagan (1989) uses a clip and magnet combination. Again, this extraneous equipment satisfies the need to direct light, but falls short of simplicity.

My proposed patent describes a compact, portable, unified form which is easy to use and difficult to damage. Its simplicity and utility clearly display the many disadvantages of other portable light patents:

A. Extraneous parts such as clips, rotating hinges, ball and socket joints, suction cups, flexible snaking types, external brackets, mounting devices and other movable joints drive up the cost of manufacturing.

B. These extraneous parts often make portable lights unbalanced and difficult to hold or carry leading to potential dropping of the light.

C. Extraneous parts can break when dropped or can damage electrical components as a result of repeated use decreasing the functional life of the light. Repeated use can also wear out movable joints rendering the light useless.

OBJECTS AND ADVANTAGES

Accordingly, all noted disadvantages are remedied by the present invention, a simple unified form which does all that these other flashlights do, but without extraneous parts. The notable advantages are:

A. While the light uses the same internal electronics for a standard portable light (i.e . . . bulb, bulb shroud, rechargeable power source, miscellaneous electronic components), the casing is a unified form made to both function and protect a single mold with minimal manufacturing time and cost.

B. The size and weight of this light can be likened to a baseball. It is easily held in hand, and is well balanced so that its flat surfaces can adhere or rest the light on any surface without tipping.

C. The present invention has no extraneous parts to wear out, to break, or to damage electrical components.

Further objects and advantages (besides creating a flashlight that offers maximal durability and utility in an exceptionally convenient shape) are to provide a light that can adhere to multiple surfaces. While the ensuing drawings describe a flashlight with magnets on those surfaces which direct light, magnets need not always be employed. For non-ferrous mounting surfaces fasteners of the hook and loop type, disposable adhesive tape, eyelets (with nail to be used on wood or walls), or other adhesive substances can be used. Likewise, no adhesive technique need be used if the light is on flat horizontal surfaces.

DRAWING FIGURES

In the drawings, each of the four figures has the same number and describes the same parts.

REFERENCE NUMERALS IN DRAWINGS

Figure 1:
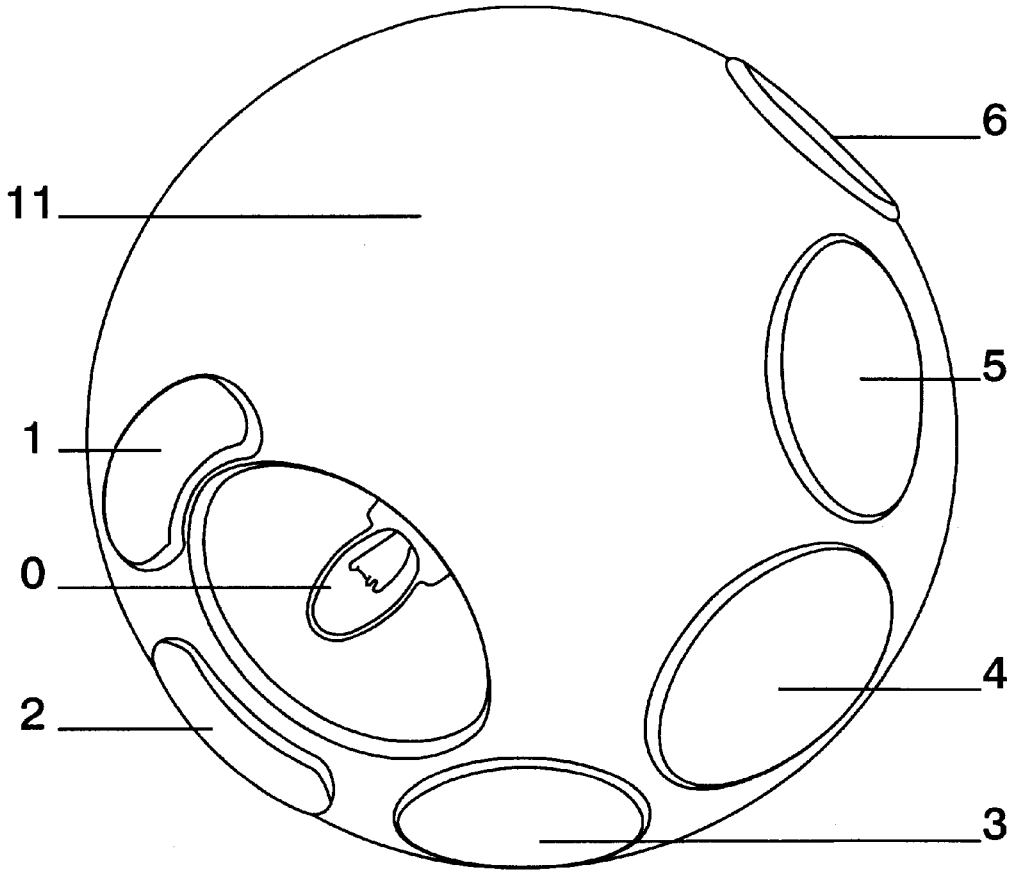
FIG. 1 shows a three-dimensional floating view of the model.

0 source and path of light at 0 degrees
1 magnet at 22.5 degrees (all angles measured from 0)
2 magnet at 45 degrees
3 magnet at 67.5 degrees
4 magnet at 90 degrees
5 magnet at 112.5 degrees
6 magnet at 135 degrees
7 magnet at 157.5 degrees
8 magnet at 180 degrees
9 on/off switch
10 recharging plug
11 outer spherical housing

SUMMARY

The essential nature of the present invention is its elemental shape. A double spiral of flat discus surfaces wrapping about a sphere provide an organic solution that is simple to use, compact, and functional.

DESCRIPTION—FIGS. 1 TO 4

A typical embodiment of the light can be seen in FIG. 1 (3-D view). A source of light can be seen at 0, and six of the eight discus surfaces (magnets 1–6) available on this model can be seen spiraling in a counter-clockwise direction from the source of light (0). The housing (11) is constructed from a high-impact plastic, nylon, or rubber material able to be dropped without fracturing and providing maximum protection to internal components. Furthermore, the light described is floating, not resting on its functional surfaces so that the maximal number of magnetic surfaces can be seen.

Figure 2:
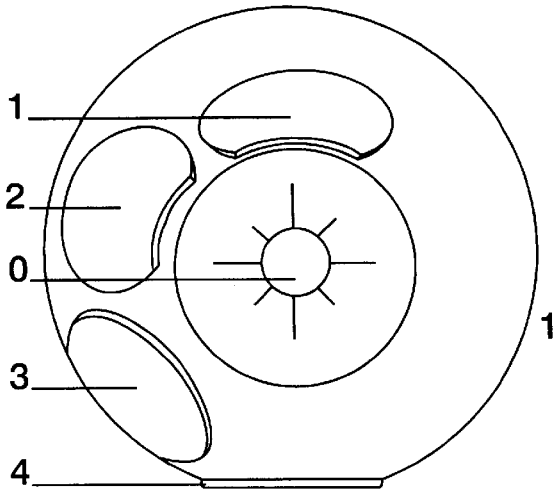
FIG. 2 shows a front view of the model describing the spiral-like magnet layout. The light source is directed at the viewer and the light itself rests on a magnet (or plane) parallel to the path of light.
Figure 3:
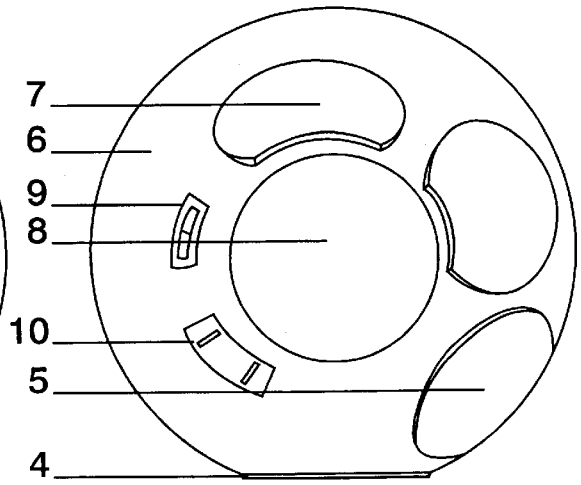
FIG. 3 shows a rear view of the model describing the spiral-like pattern of magnets as seen from behind. The light source is directed away from the viewer and the light itself rests on a magnet (or plane) parallel to the path of light.

FIG. 2 describes the layout of magnets 1–4, and rests on magnet 4. The light source (0) is pointed directly at the viewer. Similarly, FIG. 3 offers a rear view. And while still resting on magnet 4, rear magnets 4–8 can be seen. Also displayed in FIG. 3 are an on/off switch and a plug for recharging the power source.

Figure 4:
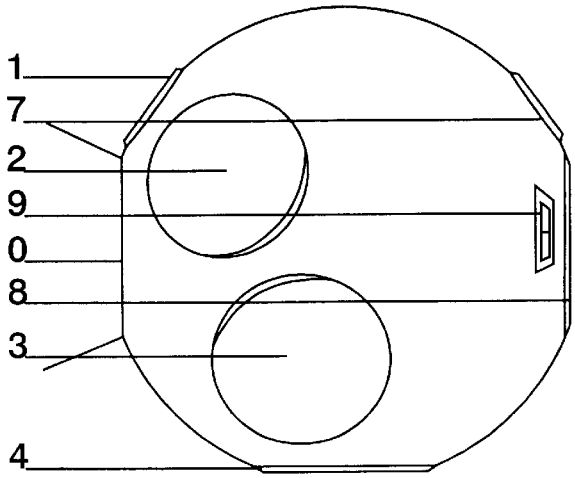
FIG. 4 shows a side view of the light. The path of light travels perpendicular to the viewer, and parallel to a magnet (or plane) on which it rests.

FIG. 4 offers an alternate view of a light as it rests on magnet 4. The light source 0 can be seen to the left of this model, while magnets 1–4,7,8 are also pictured. FIGS. 1–3, combined, display a light as it is seen resting on magnet 4 from three directions in order to provide the viewer with a clear mental image. The same can be done by drawing a light resting at magnets 1–3 or 5–8, but will not be drawn so as not to be redundant.

OPERATION—FIGS. 1–4

From FIGS. 1–4 it can be seen that this model can adhere to any flat, ferromagnetic material at any given magnet 1–8; thereby, directing focused light at any desired angle.

For example, with the light illuminated, the present model can be placed on horizontal surface. From magnet 6 the light will shine upward at a 45 degree angle. The light can be then turned about that axis (perpendicular to magnet 6). This operation can be repeated for any magnet 1–8, and implies a lightable range of 360 degrees. The same range applies on a vertical surface, a flat surface, or a magnetic surface at any angle.

CONCLUSION, RAMIFICATIONS AND SCOPE

Furthermore, the present light provides an opportunity to simplify the world of portable lighting. This ball-like flashlight makes hands-on use comfortable and convenient, and readily becomes a hands-off work light with great ease.

It does not employ gadgets or extraneous parts to direct light, rather it allows its organic shape to be subject to its function. The magnets move about the sphere in a spiral-like pattern in order to maximize possible surface area for the magnets. But like in nature, the sphere/double-spiral combination is a plastic one, in that, there may be multiple spirals across the surface or a single spiral can be tightened about its axis allowing for more angles. This relationship can be adjusted to the demands of the light.

The previously stated demands for a work light have been more simply fulfilled with the present invention than with any previously patented solutions. The light is compact, easy to use, able to direct light in any direction, and can adhere itself to any angle.

Although the model above contains many specificities these should not be construed to limit the scope of the invention, but rather to offer a possible embodiment of the invention. The scope of the invention should not be determined by the given example, but by the appended claims and their legal equivalents.

What is claimed is:

1. A spherical light housing for directing light in a multitude of directions, comprising:

(a) a spherical housing containing inset lighting components (b) a plurality of flat surfaces around said housing (c) said flat surfaces having means for adhering said housing to an alternate surface.

* * * * *